US005965316A

United States Patent [19]

Kmiecik-Lawrynowicz et al.

[11] Patent Number: 5,965,316

[45] Date of Patent: Oct. 12, 1999

[54] WAX PROCESSES

[75] Inventors: Grazyna E. Kmiecik-Lawrynowicz, Fairport; Chieh-Min Cheng, Rochester, both of N.Y.

[73] Assignee: Xerox Corporation, Stamford, Conn.

[21] Appl. No.: 09/169,815

[22] Filed: Oct. 9, 1998

[51] Int. Cl.[6] ..... G03G 9/087

[52] U.S. Cl. ..... 430/137; 430/109

[58] Field of Search ..... 430/137, 106, 430/109

[56] References Cited

U.S. PATENT DOCUMENTS

| | | | |
|---|---|---|---|
| 3,674,736 | 7/1972 | Lerman et al. | 260/41 R |
| 4,137,188 | 1/1979 | Uetake et al. | 252/62.1 P |
| 4,558,108 | 12/1985 | Alexandru et al. | 526/340 |
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,066,560 | 11/1991 | Tan et al. | 430/137 |
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,348,832 | 9/1994 | Sacripante et al. | 430/109 |
| 5,364,729 | 11/1994 | Kmiecik-Lawrynowicz et al. | 430/137 |
| 5,366,841 | 11/1994 | Patel et al. | 430/137 |
| 5,370,963 | 12/1994 | Patel et al. | 430/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. | 430/137 |
| 5,496,676 | 3/1996 | Croucher et al. | 430/137 |
| 5,501,935 | 3/1996 | Patel et al. | 430/137 |
| 5,527,658 | 6/1996 | Hopper et al. | 430/137 |
| 5,561,025 | 10/1996 | Torres et al. | 430/137 |
| 5,585,215 | 12/1996 | Ong et al. | 430/137 |
| 5,650,255 | 7/1997 | Ng et al. | 430/137 |
| 5,650,256 | 7/1997 | Veregin et al. | 430/137 |
| 5,766,817 | 6/1998 | Cheng et al. | 430/137 |
| 5,766,818 | 6/1998 | Smith et al. | 430/137 |
| 5,843,612 | 12/1998 | Lin et al. | 430/137 |
| 5,853,942 | 12/1998 | Lin | 430/137 |

FOREIGN PATENT DOCUMENTS

| | | |
|---|---|---|
| 1442835 | 7/1976 | United Kingdom . |

*Primary Examiner*—John Goodrow
*Attorney, Agent, or Firm*—E. O. Palazzo

[57] ABSTRACT

A process for the preparation of toner comprising (i) aggregating a colorant dispersion with an encapsulated wax;

(ii) coalescing or fusing the aggregates generated; and optionally (iii) isolating, washing, and drying the toner.

27 Claims, No Drawings

WAX PROCESSES

PENDING APPLICATIONS AND PATENTS

Illustrated in the following copending applications, the disclosures of which are totally incorporated herein by reference, are: U.S. Ser. No. 960,754 cleavable surfactants; U.S. Pat. No. 5,766,818 toner emulsion/aggregation processes with cleavable surfactants; U.S. Ser. No. 959,798 toner emulsion/aggregation processes with water miscible chain transfer agents; U.S. Pat. No. 5,766,817 toner emulsion/aggregation processes with miniemulsions; U.S. Ser. No. 005,281 processes for the preparation of toner wherein a reactive surfactant is selected; and U.S. Ser. No. 005,420 process for the preparation of a latex comprising the polymerization of monomer in the presence of a chain transfer component, an initiator, a diphenyloxide disulfonate, and an optional nonionic surfactant.

Also, disclosed in copending application U.S. Ser. No. 058,738 is a process for the preparation of toner comprising:

(i) preparing, or providing a colorant;

(ii) preparing, or providing a wax dispersion comprised of a functionalized wax, contained in a dispersant mixture comprised of a nonionic surfactant, an ionic surfactant, or mixtures thereof;

(iii) shearing the resulting mixture of the wax dispersion (ii) and the colorant dispersion (i) with a latex or emulsion blend comprised of resin particles suspended in a mixture of an anionic surfactant and a nonionic surfactant;

(iv) heating the resulting sheared blend of (iii) below about the glass transition temperature (Tg) of the resin particles;

(v) optionally adding additional anionic surfactant to the resulting aggregated suspension of (iv) to prevent, or minimize additional particle growth of the resulting electrostatically bound toner size aggregates during coalescence (iv);

(vi) heating the resulting mixture of (v) above about the Tg of the resin particles; and optionally (vii) separating the toner particles.

The appropriate components and processes of the copending applications may be selected for the present invention in embodiments thereof.

BACKGROUND OF THE INVENTION

The present invention is generally directed to toner processes, and more specifically, to aggregation and coalescence or fusion of a resin containing latex, colorant, such as pigment, dye, or mixtures thereof, and optional additive particles, and wherein there is selected a wax and which wax is substantially totally incorporated, that is, for example, from about 80 to about 100 percent, and more specifically, from about 90 to about 100 percent, and wherein there is minimal or no wax escaping from the toner. Thus, with the processes of the present invention there is enabled substantially no wax rejection, and therefore wax is not available to contaminate the environment within which it is used, such as a xerographic imaging apparatus, and wherein image streaking is substantially avoided, and image transfer is excellent.

The process of the present invention relates, for example, to the use of a wax dispersion in water as a seed to form encapsulated wax particles, and thereafter accomplishing an emulsion/aggregation/coalescence to form toner.

PRIOR ART

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. This process is thus directed to the use of inorganic magnesium sulfate, which results in the formation of particles with a wide particle size distribution. In U.S. Pat. No. 4,797,339, there is disclosed a process for the preparation of toners by resin emulsion polymerization, wherein similar to the '127 patent certain polar resins are selected; and in U.S. Pat. No. 4,558,108, there is disclosed a process for the preparation of a copolymer of styrene and butadiene by suspension polymerization.

In U.S. Pat. No. 5,561,025, the disclosure of which is totally incorporated herein by reference, there is illustrated emulsion/aggregation/coalescence processes wherein water phase termination agents are selected.

Other prior art that may be of interest includes U.S. Pat. Nos. 3,674,736; 4,137,188 and 5,066,560.

Emulsion/aggregation processes for the preparation of toners with optional charge control additives are illustrated in a number of Xerox Corporation patents, the disclosures of each of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256 and 5,501,935 (spherical toners). The appropriate processes and components of these patents may be selected for the formation of toner compositions utilizing in accordance with embodiments of the present invention.

SUMMARY OF THE INVENTION

It is a feature of the present invention to provide toner processes with many of the advantages illustrated herein.

In another feature of the present invention there are provided simple and economical processes for the preparation of black and colored toner compositions with excellent colorant, especially pigment dispersions, and which toners contain wax, about 90 to about 100 percent, and in many instances 98 to 100 percent, totally incorporated therein thus enabling the achievement of excellent image release minimal or no wax rejection, excellent color print quality, and wherein the toners possess excellent fusing characteristics.

In a further feature of the present invention there is provided a process for the preparation of sediment free emulsions and toner compositions thereof with a volume average diameter of from between about 1 to about 20 microns, and preferably from about 2 to about 12 microns, and a particle size distribution of about 1.10 to about 1.35, and preferably from about 1.15 to about 1.25 as measured by a Coulter Counter without the need to resort to conventional classifications to narrow the toner particle size distribution and which toners contain wax fully incorporated therein.

In a further feature of the present invention there is provided a process for the preparation of toner by aggregation and coalescence, or fusion (aggregation/coalescence) of latex, colorant, wax, and additive particles, and wherein the latex is substantially sediment free.

In yet another feature of the present invention there are provided toner compositions with low fusing temperatures of from about 120° C. to about 180° C., and which toner compositions exhibit excellent blocking characteristics at and above about 45° C.

These and other features of the present invention are accomplished in embodiments by the provision of toners and processes thereof. In embodiments of the present invention, there are provided sediment free, or substantially sediment free processes for the preparation of toner compositions with wax incorporated therein by the aggregation/coalescence of latex, wax, especially encapsulated wax, and colorant, especially pigment particles, and wherein the temperature of the aggregation may be selected to control the aggregate size, and thus the final toner particle size, and the coalescence temperature and time may be utilized to control the toner shape and surface properties.

Aspects of the present invention include a process for the preparation of toner comprising (i) aggregating a colorant dispersion with an encapsulated wax;

(ii) coalescing or fusing the aggregates generated; and optionally (iii) isolating, washing, and drying the toner; a process wherein the encapsulated wax is generated by the free radical polymerization of a wax dispersion, monomer, and initiator, and wherein the free radical polymerization is accomplished by heating at a temperature of from about 25° C. to about 125° C. and there results the wax incorporated in a shell polymer, and wherein the thickness of the shell is from about 0.01 to about 0.3 micron; a process wherein the wax is present as a dispersion in water, and wherein the wax is present in an amount of about 1 to about 35 percent by weight; a process wherein the wax is encapsulated within a polymer and the aggregating is below about the polymer glass transition temperature present as a latex emulsion, the coalescing or fusing of the aggregates is above about the polymer glass transition temperature, and there results toner with a size of from about 2 to about 20 microns in volume average diameter; a process wherein the temperature below the glass transition temperature is from about 25° C. to about 60° C., and the heating above the glass transition temperature is from about 60° C. to about 100° C.; a process wherein the temperature below the glass transition temperature is from about 35° C. to about 55° C., and the heating above the glass transition temperature is from about 70° C. to about 95° C.; a process wherein the temperature at which the aggregation is accomplished controls the size of the aggregates, and wherein the final toner size is from about 2 to about 10 microns in volume average diameter, and wherein the temperature and time of the coalescence or fusing of the components of aggregates control the shape of the resultant toner; a process wherein the aggregation temperature is from about 45° C. to about 55° C., and wherein the coalescence or fusing temperature is from about 80° C. to about 95° C.; a wherein there is further selected a cosurfactant selected from the group consisting of alkanes, hydrocarbyl alcohols, ethers, amines, halides, and esters; a wherein the colorant is a pigment, and wherein the pigment dispersion contains an ionic surfactant; a process wherein there is further included a surfactant in the colorant dispersion, and which surfactant is a cationic surfactant; a process wherein the aggregating is conducted at a temperature of about 15° C. to about 1° C. below the Tg of the latex polymer, or latex resin for a duration of from about 0.5 hour to about 3 hours; and wherein the coalescence or fusing of the components of aggregates for the formation of integral toner particles comprised of colorant, resin, encapsulated wax, and additives is accomplished at a temperature of about 85° C. to about 105° C. for a duration of from about 1 hour to about 5 hours, and wherein the wax is substantially totally incorporated in the toner; a process wherein the wax is encapsulated within a polymer selected from the group consisting of poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid; a process wherein the colorant is aggregated with an encapsulated wax latex containing a polymer selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), and poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), and poly(styrene-butyl acrylate-acrylonitrile-acrylic acid; a process wherein the colorant is carbon black, cyan, yellow, magenta, and mixtures thereof; a process wherein the toner particles isolated are from about 2 to about 10 microns in volume average diameter, and the particle size distribution thereof is from about 1.15 to about 1.30, and wherein there is added to the surface of the formed toner metal salts, metal salts of fatty acids, silicas, metal oxides, or mixtures thereof, each in an amount of from about 0.1 to about 10 weight percent of the obtained toner particles; a process wherein the wax is an alkylene; a process wherein the wax is paraffin, polyethylene, polypropylene, or silicone waxes; the paraffin waxes have a molecular weight $M_w$ of from 400 to about 1,000, an $M_n$ of from 300 to about 800, and a melting temperature Tm of from 50° C. to about 100° C.; the polyethylene waxes have an $M_w$ of from 1,000 to about 2,000, an $M_n$ of from 500 to about 1,500, and a Tm of from 70° C. to about 1 30° C.; the polyethylene waxes have an $M_w$ of from 1,000 to about 10,000, an $M_n$ of from 500 to about 8,000, and a Tm of from 120° C. to about 180° C.; and the silicone waxes have an $M_w$ of from 5,000 to about 20,000, an $M_n$ of from 2,000 to about 15,000, and a Tm of from 30° C. to about 90° C.; a process wherein the encapsulated wax is present in the toner product in an amount of about 1 to about 10 weight percent; a process for minimizing the amount of wax that escapes from a toner, which process comprises the mixing of a latex, an encapsulated wax, and a colorant dispersion; heating below about, or equal to about the resin Tg, and heating above about, or equal to about the resin Tg; a process for the preparation of toner comprising (i) aggregating a colorant with a polymer encapsulated wax;

(ii) coalescing, and optionally (iii) isolating, washing, and drying the toner; a process wherein the encapsulated wax is generated by the free radical polymerization of a wax dispersion, monomer, and initiator, and isolating, washing, and drying is accomplished; a process wherein isolating, washing, and drying are accomplished, and wherein prior to the isolating cooling is accomplished subsequent to coalescing; a toner obtained by the process; a developer comprised of the toner obtained by the process and carrier; a process wherein the wax is encapsulated within a polymer; a process wherein the wax is polyethylene, polypropylene, or mixtures thereof; direct toner preparative process comprised of blending an aqueous colorant dispersion containing, for example, a colorant, such as red, green, blue, brown, orange, HELIOGEN BLUE™ or HOSTAPERM PINK™, and a cationic surfactant such as benzalkonium chloride (SANIZOL B-50™), the polymer encapsulated wax, and a latex emulsion containing an anionic surfactant, and an optional cosurfactant, and wherein the latex polymer is derived from emulsion polymerization of monomers selected, for example, from the group consisting of styrene, acrylates, methacrylates, acrylonitrile, butadiene, acrylic acid, methacrylic acid, and the like, thereby resulting in the flocculation of the polymer particles with the colorant particles, wax, and optional additives, and which flocculent mixture, on further stirring at a temperature of from about 35° C. to about 60° C., results in the formation of toner sized aggregates having an aggregate size of from about 2 microns to about 20 microns in volume average diameter as measured by the Coulter Counter (Microsizer II) and a particle size distribution of about 1.15 to about 1.35; thereafter, heating the aggregate suspension at from about 70° C. to about 95° C. to form toner particles, followed by cooling, isolation by for example filtration, washing, to primarily remove surfactants, and drying in an oven, or the like, and wherein the toners, which contain wax in a very high amount, for example about 90 to about 100 percent, are especially useful for imaging processes, especially xerographic processes, which usually require high, for example about 90 to about 95 percent, toner transfer efficiency, such as those having a compact machine design without a cleaner or those that are designed to provide high quality colored images with excellent image resolution and signal-to-noise ratio, and image uniformity; and oxygen free, and sediment free emulsion processes, and wherein there is selected in situ seed, low agitation monomer addition, and wherein there is selected for the emulsion polymerization a diphenyloxide disulfonate, such as DOWFAX 2A1™, sodium tetrapropyl diphenyloxide disulfonate, available from Dow Chemical;

(i) blending an aqueous pigment dispersion containing an ionic surfactant, and an emulsion latex containing resin, or polymer, an emulsifier with a charge polarity opposite to that of the ionic surfactant in the pigment dispersion and an encapsulated wax;

(ii) heating the resulting mixture at a temperature of about 25° C. to about 1° C. below the Tg (glass transition temperature) of the latex resin, or polymer to form toner sized aggregates;

(iii) subsequently heating the aggregates to a temperature of about 75° C. to about 120° C. to effect coalescence or fusion of the components of aggregates to enable formation of integral toner particles comprised of polymer, and pigment; and (iv) isolating the toner product by, for example, filtration, followed by washing and drying; processes for the preparation of toner compositions which comprise (i) preparing an ionic colorant mixture by dispersing a colorant, especially pigment, such as carbon black, red, blue, HOSTAPERM PINK™, or PV FAST BLUE™ in an aqueous surfactant solution containing a cationic surfactant, such as dialkylbenzene dialkylammonium chloride like SANIZOL B-50™ available from Kao, or MIRAPOL™ available from Alkaril Chemicals, by means of a high shearing device such as a Brinkmann Polytron or IKA homogenizer; (ii) adding polymer encapsulated wax to the aforementioned colorant, especially pigment mixture, and wherein the polymer encapsulating the wax is comprised of polymer particles of, for example, poly(styrene-butyl acrylate-acrylic acid), poly(styrene-butadiene-acrylic acid), and the like, a sulfonate emulsifier, a nonionic surfactant, such as polyethylene glycol or polyoxyethylene glycol nonyl phenyl ether or IGEPAL 897™ obtained from GAF Chemical Company, and an optional cosurfactant, thereby causing a flocculation of pigment inclusive of dyes and other colorants, polymer particles, wax, and optional additives; (iii) homogenizing the resulting flocculent mixture with a high shearing device, such as a Brinkmann Polytron or IKA homogenizer, and further stirring with a mechanical stirrer at a temperature of about 1° C. to about 25° C. below the Tg of the latex polymer to form toner sized aggregates of from about 2 microns to about 20 microns in volume average diameter; (iv) heating the mixture in the presence of additional anionic surfactant or nonionic surfactant at a temperature of 120° C. or below for a duration of, for example, from about 1 to about 5 hours to form 2 to about 20 micron toner preferably with a particle size distribution of from about 1.15 to about 1.35 as measured by the Coulter Counter; and (v) isolating the toner particles by filtration, washing, and drying. Additives to improve flow characteristics and charge additives, if not initially present, to improve charging characteristics may then be added by blending with the formed toner, such additives including AEROSILS® or silicas, metal oxides like tin, titanium and the like, metal salts of fatty acids like zinc stearate, and which additives are present in various effective amounts, such as from about 0.1 to about 10 percent by weight of the toner; latex emulsion processes and aggregation and coalescence thereof with colorant particles, and wherein there is provided substantially sediment free wax containing toner compositions with a volume average diameter of from about 1 micron to about 20 microns, and preferably from about 2 microns to about 12 microns and a narrow particle size distribution of, for example, about 1.10 to about 1.45 as measured by the Coulter Counter method, without the need to resort to conventional toner pulverization and classification methods. The resulting toners can be selected for known electrophotographic imaging and printing processes, including digital color processes.

More specifically, the present invention is directed to toner wax incorporation processes and substantially sediment free processes comprised of (1) mixing a wax dispersion, which dispersion contains a wax, especially a low molecular weight, such as about 400 to about 20,000 Mw, wax, and water, wherein the wax is present in an amount of for example, about 1 to about 20, and preferably about 3 to about 15 weight percent, with a mixture of a monomer and an initiator, and thereafter accomplishing a free radical polymerization by heating at a temperature of for example, about 25° C. to about 125° C., and preferably about 50° C. to about 95° C., whereby there results a wax encapsulated in a polymer and the polymer forms a shell around the wax; (2) aggregating with a colorant dispersion by heating at about equal to, or about below the glass transition temperature, Tg, of the shell polymer; (3) coalescing and fusing by heating at about equal to, or about above the Tg of the polymer; (4) and optionally cooling, isolating the toner, and washing and drying and wherein there results a toner containing wax substantially incorporated therein, for example from about 90 to about 100 percent, and wherein no, or only minimal wax rejection occurs. The waxes are present in the toner composition in an amount of from about 1 percent by weight to about 20 percent by weight, and preferably in an amount of from about 2 percent by weight to about 15 percent by weight.

The present invention relates to the preparation of wax encapsulated latexes. More specifically, the present invention is directed to wax encapsulated latexes prepared by a semi-continuous emulsion polymerization. The resulting latex polymer composition is thus comprised of a wax encapsulated latex whereby a wax is encapsulated in a polymer and a polymer forms a shell around the wax, wherein the latex particles comprise, for example, about 2 to about 30 percent, and preferably about 5 to about 20 percent by weight of the wax and, for example, about 70 to about 98 percent, and preferably about 80 to about 95 percent, by weight of a polymeric shell thereover with the total of wax and polymer being about 100 percent. The polymeric shell can be formed on the wax by emulsion polymerization of, for example, a suitable monomer, such as an ethylenically unsaturated monomer or monomers in the presence of the wax emulsion. The monomers of the shell forming monomer composition which form the polymer shell that encapsulates the wax are selected in a manner to preferably provide a glass transition temperature (Tg) of the shell of, for example, about 30° C. to about 70° C., and preferably about 40° C. to about 60° C., and a weight average molecular weight ($M_w$) of, for example, about 10,000 to about 100,000, and preferably of, for example, about 20,000 to about 50,000. Also, the process of the present invention relates to the preparation of a wax encapsulated latex by a semi-continuous emulsion polymerization, wherein a shell or coating is formed on the wax particles by emulsion polymerization of a monomer composition preferably in the presence of a wax emulsion. More specifically, there is polymerized a shell monomer with a glass transition temperature for the shell of, for example, about 30° C. to about 70° C., and preferably about 40° C. to about 60° C., and a weight average molecular weight of, for example, about 10,000 to about 100,000, and preferably of about 20,000 to about 50,000 by (i) mixing a wax emulsion with water, and optionally surfactant or surfactants, while heating at a temperature of, for example, from about 35° C. to about 125° C.;

(ii) conducting a pre-reaction monomer emulsification, which comprises emulsification of the polymerization reagents of monomers, and optional, but preferably a chain transfer agent, surfactant, and an initiator, and wherein the emulsification is accomplished at a low temperature of, for example, from about 5° C. to about 45° C.;

(iii) feed adding to the wax emulsion of (i) to the monomer emulsion of (ii) used to prepare the shell copolymer, and an optional free radical initiator, from about 0.5 to about 99.5 percent by weight, and preferably from about 0 to about 97 percent by weight of total initiator used to prepare the shell copolymer resin, and heating at a temperature of, for example, from about 35° C. to about 125° C., and (iv) retaining the resulting mixture at a temperature of, for example, from about 35° C. to about 125° C. for an effective time period, for example from about 0.5 to about 6 hours, and preferably from about 1 to about 4 hours, followed by cooling to about room temperature, about 25° C. to about 30° C., and wherein there results the desired wax encapsulated latex comprised of a wax, and a polymer shell with, for example, a glass transition temperature of about 30° C. to about 70° C., and preferably about 40° C. to about 60° C., and a weight average molecular weight of, for example, about 10,000 to about 100,000, and preferably about 20,000 to about 50,000, and wherein the polymer shell possesses a suitable thickness of, for example, about 0.01 micron to about 0.3 micron, and preferably from about 0.03 micron to about 0.2 micron.

The resin or polymer selected can be prepared by a number of suitable methods, and can be preferably prepared by emulsion polymerization methods, and the monomers utilized in such processes include, for example, styrene, acrylates, methacrylates, butadiene, isoprene, acrylonitrile, acrylic acid, methacrylic acid, styrene acrylates, styrene methacrylates, and the like. Styrene/acrylate monomer mixture is particularly well suited for use in the preparation of wax encapsulated of the present invention. A typical styrene/acrylate formulation can be comprised of from about 50 to about 90 weight percent of styrene, from about 5 to about 50 weight percent of acrylate, and from about 0.5 to about 10 weight percent of acrylic acid.

The polymerization of monomers, such as ethylenically unsaturated monomers, in an aqueous medium is generally accomplished with free radical catalysts. A variety of free radical initiator systems can be used which include thermally generated free radical initiation systems such as those based upon persulfates, like ammonium persulfate, sodium persulfate and the like, peroxides, like hydrogen peroxide, t-butyl hydroperoxide, cumene hydroperoxide, paramenthane hydroperoxide, peroxy carbonates, azo compounds such as 4,4'-azobis(4-cyanovaleric acid), 1,1'-azobis (1-methylbutyronitrile-3-sodium sulfonate), 2,2'-azobis(2-amidinopropane) dihydrochloride, 2,2'-azobis(2-amidinopropane) dihydrochloride, and the like, and reduction/oxidation (redox) systems. Examples of redox systems include t-butyl hydroperoxide and a sodium formaldehyde sulfoxylate reducing agent, or hydrogen peroxide, and the reducing agent. Suitable amounts of initiator for emulsion polymerization range are, for example, from about 0.01 to about 5 weight percent, and preferably from about 0.5 to about 3 percent by weight of total monomers used to prepare the shell polymer.

Reaction conditions selected for effecting the emulsion polymerization of the monomer in the presence of wax include temperatures ranging, for example, from about 35° C. to about 125° C., and preferably about 50° C. to about 95° C. Preferably the polymerization is affected at elevated temperatures, which is within 10 percent of the melting point of the wax, for example from about 70° C. to about 95° C. to, for example, permit the wax to soften thereby promoting dispersion and incorporation into the emulsion.

In the monomer emulsion addition process, water, for example from about 5 to about 90 percent by weight, and preferably from about 10 to about 50 percent by weight of total water used to prepare the latex emulsion, emulsifier from about 5 to about 50 percent by weight, and preferably from about 5 to about 35 percent by weight of total monomers used to prepare the copolymer resin, chain transfer agent, from about 0.5 to about 10 percent by weight, and preferably from about 1 to about 5 percent by weight of total monomers used to prepare the polymer shell, and initiator, from about 0.01 to about 5 percent by weight, and preferably from about 0.5 to about 3 percent by weight of total monomers used to prepare the copolymer resin, are emulsified, then added to the reactor.

Various specific processes of the present invention include the following.

Aggregation/Coalescence Process 1

A process for the preparation of toner comprised of polymer and colorant, especially pigment, and encapsulated wax, comprising (i) blending an aqueous colorant dispersion containing an ionic surfactant, and a wax encapsulated emulsion latex containing polymer and an encapsulated wax, and an emulsifier with a charge polarity opposite to that of the ionic surfactant in the colorant dispersion;

(ii) heating the resulting mixture at a temperature of about 25° C. to about 1° C. below the Tg (glass transition temperature) of the latex resin, or polymer to form toner sized aggregates;

(iii) subsequently heating the resulting aggregate suspension to a temperature of about 75° C. to about 120° C. to effect coalescence or fusion of the components of aggregates to enable formation of integral toner particles comprised of polymer and colorant; and (iv) isolating the toner product by, for example, filtration, followed by washing and drying; and (i) preparing an ionic colorant mixture by dispersing a colorant, especially pigment, in an aqueous surfactant solution containing a suitable surfactant, such as a cationic surfactant, by means of a high shearing device such as a Brinkmann Polytron or IKA homogenizer; (ii) adding an encapsulated wax emulsion latex containing wax encapsulated within a polymer to the aforementioned colorant, especially pigment mixture, and wherein the polymer encapsulating the wax is comprised of polymer particles of, for example, poly (styrene-butyl acrylate-acrylic acid), poly(styrene-butadiene-acrylic acid), and the like, and wherein the wax content is about 1 to about 20 weight percent, and preferably about 3 to about 15 weight percent, and there is enabled a thin polymer shell, for example from about 0.01 to about 0.3, and preferably about to 0.03 about 0.2 micron, a sulfonate emulsifier, a nonionic surfactant such as polyethylene glycol or polyoxyethylene glycol nonyl phenyl ether, thereby causing a flocculation of colorant, polymer encapsulated wax particles, and optional additives; (iii) homogenizing the resulting flocculent mixture with a high shearing device, such as a Brinkmann Polytron or IKA homogenizer, and further stirring with a mechanical stirrer at a temperature of about 1° C. to about 25° C. about below the Tg of the latex polymer, for example in the range of from between about 25° C. and about 60° C., to form statically bound toner sized aggregates of from about 2 microns to about 20 microns in volume average diameter with a particle size distribution of, for example from about 1.15 to about 1.35 as measured by the Coulter Counter; (iv) heating the mixture in the presence of additional anionic surfactant or nonionic surfactant in a suitable quantity of, for example, from about 0.1 to about 3.0 percent by weight of the total suspension at a temperature of about 120° C. or below, for example in the range of from between about 75° C. and about 105° C., for a suitable duration of, for example, from about 1 to about 5 hours to from about 2 to about 12 micron toner preferably with a particle size distribution of from about 1.15 to about 1.35 as measured by the Coulter Counter; and (v) isolating the toner particles by filtration, washing, and drying. The wax is preferably present in the toner composition in an amount of from about 1 percent by weight to about 20 percent by weight, and more preferably in an amount of from about 2 percent by weight to about 15 percent by weight.

Aggregation/Coalescence Process 2

Aspects of the present invention also relate to the formation of a wax encapsulated with a polymer by mixing two latexes, one comprised of a dispersion of resin, or polymer in water, and a second latex comprised of a wax encapsulated within a polymer shell, and prepared as indicated herein, and wherein the wax content is high, for example about 5 to about 35 weight percent, and preferably about 10 to about 30 weight percent, and there is enabled a thin polymer shell, for example from about 0.01 to about 0.3, and preferably about 0.03 to about 0.2 micron, as measured by the light scattering technique on a Coulter N4 Plus Particle Sizer, or by cross section technique on a transmission electron microscope; thereafter the resulting mixture comprised of a wax encapsulated latex and a polymer latex, which contained no wax, can be utilized to form a toner by emulsion/aggregation/coalescence, as indicated herein, wherein the wax encapsulated latex is present in an amount, for example, of from about 30 to about 70 weight percent, and the latex with no wax is present in an amount of from about 30 to about 70 weight percent, wherein the wax is present in the final toner composition in an amount of from about 1 percent by weight to about 20 percent by weight, and preferably in an amount of from about 2 percent by weight to about 15 percent by weight; a process for the preparation of toner comprised of polymer and colorant, and encapsulated wax comprising (i) blending an aqueous colorant dispersion containing an ionic surfactant, and a wax encapsulated emulsion latex containing polymer and an encapsulated wax, a polymer emulsion latex with no wax, an emulsifier with a charge polarity opposite to that of the ionic surfactant in the colorant dispersion;

(ii) heating the resulting mixture at a temperature of about 25° C. to about 1° C. below the Tg (glass transition temperature) of the latex resin, or polymer to form toner sized aggregates;

(iii) subsequently heating the aggregates to a temperature of about 75° C. to about 120° C. to effect coalescence or fusion of the components of aggregates to enable the formation of integral toner particles comprised of polymer, and colorant; and (iv) cooling, for example to about 25 to about 45° C., isolating the toner product by, for example, filtration, followed by washing, primarily to remove surfactants, and drying; and processes for the preparation of toner compositions which comprise (i) preparing an ionic colorant mixture by dispersing a colorant, especially pigment, in an aqueous surfactant solution containing a cationic surfactant, by means of a high shearing device such as a Brinkmann Polytron or IKA homogenizer; (ii) adding a polymer encapsulated wax emulsion, and a polymer emulsion latex with no wax to the aforementioned colorant, especially pigment mixture, and wherein the wax encapsulated latex is present in an amount, for example, of from about 30 to about 70 weight percent, and the latex with no wax is present in an amount of from about 30 to about 70 weight percent, and wherein the polymer encapsulating the wax is comprised of a polymer of, for example, poly(styrene-butyl acrylate-acrylic acid), poly(styrene-butadiene-acrylic acid), and the like, and wherein the wax content is about 5 to about 35 weight percent, and preferably about 10 to about 30 weight percent, and there is enabled a thin polymer shell, for example from about 0.01 to about 0.3, and preferably about to 0.03 about 0.2 micron, an emulsion such as a sulfonate emulsifier, a nonionic surfactant such as polyethylene glycol or polyoxyethylene glycol nonyl phenyl ether, and wherein the polymer emulsion latex with no wax is comprised of polymer particles of, for example, poly (styrene-butyl acrylate-acrylic acid), poly(styrene-butadiene-acrylic acid), and the like, the sulfonate emulsifier, a nonionic surfactant such as polyethylene glycol or polyoxyethylene glycol nonyl phenyl ether, thereby causing a flocculation of pigment, polymer particles, wax, and optional additives; (iii) homogenizing the resulting flocculent mixture with a high shearing device, such as a Brinkmann Polytron or IKA homogenizer, and further stirring with a mechanical stirrer at a temperature of about 1° C. to about 25° C. below the Tg of the latex polymer, for example in the range of from between about 25° C. and about 60° C., to form statically bound toner sized aggregates of from about 2 microns to about 20 microns in volume average diameter with a particle size distribution of from about 1.15 to about 1.35 as measured by the Coulter Counter; (iv) heating the mixture in the presence of additional anionic surfactant or nonionic surfactant in an amount of from between 0.1 and 3.0 percent by weight of the total suspension at a temperature of 120° C. or below, for example in the range of from between about 75° C. and about 105° C., for a duration of, for example, from about 1 to about 5 hours to form 2 to about 12 micron toner, preferably with a particle size distribution of from about 1.15 to about 1.35 as measured by the Coulter Counter; and (v) isolating the toner particles by filtration, washing, and drying. The wax is present in the final toner composition in an amount of from about 1 percent by weight to about 20 percent by weight, and preferably in an amount of from about 2 percent by weight to about 15 percent by weight.

Aggregation/Coalescence Process 3

Alternatively, there can be selected two latexes, one with a high wax content, wherein high is from about 5 to about 35 weight percent, preferably about 10 to about 30 weight percent, and there is enabled a thin polymer shell, for example from about 0.01 to about 0.2, and preferably about to 0.03 about 0.15 micron, as measured by the light scattering technique on a Coulter N4 Plus Particle Sizer, or by cross section technique on a transmission electron microscope, and one with no wax, and wherein for the formation of toner the latex with no wax is subjected to aggregation by heating below about the Tg of the polymer present in the latex, and thereafter there is added the wax containing latex with the wax incorporated into a shell polymer, followed by coalescing by heating at about above the Tg of the polymer, wherein the wax encapsulated latex is present in an amount, for example of from about 10 to about 50 weight percent of the total latexes used for toner, and the wax is present in the final toner composition in an amount of from about 1 percent by weight to about 15 percent by weight, and preferably in an amount of from about 2 percent by weight to about 10 percent by weight; a process for the preparation of toner comprised of polymer and colorant, especially pigment, and encapsulated wax, comprising (i) blending an aqueous pigment dispersion containing an ionic surfactant, and an emulsion latex containing polymer, an emulsifier with a charge polarity opposite to that of the ionic surfactant in the pigment dispersion;

(ii) heating the resulting mixture at a temperature of about 25° C. to about 3° C. below the Tg (glass transition temperature) of the latex resin, or polymer to form aggregates;

(iii) adding a wax encapsulated emulsion latex containing a polymer encapsulated wax to the aggregates;

(iv) heating the resulting mixture at a temperature of about 25° C. to about 1° C. below the Tg (glass transition temperature) of the latex resin, or polymer to form toner sized aggregates;

(v) subsequently heating the resulting aggregate suspension to a temperature of about 70° C. to about 120° C. to effect coalescence or fusion of the components of aggregates to enable formation of integral toner particles comprised of polymer, and colorant; and (vi) isolating the toner product by, for example, filtration, followed by washing and drying; and (i) preparing an ionic colorant mixture by dispersing a colorant, especially pigment, in an aqueous surfactant solution containing a cationic surfactant, by means of a high shearing device such as a Brinkmann Polytron or IKA homogenizer; (ii) adding an emulsion latex containing polymer to the aforementioned colorant, especially pigment mixture, and wherein the polymer emulsion is comprised of polymer particles of, for example, poly (styrene-butyl acrylate-acrylic acid), poly(styrene-butadiene-acrylic acid), and the like, and a sulfonate emulsifier, a nonionic surfactant such as polyethylene glycol or polyoxyethylene glycol nonyl phenyl ether, thereby causing a flocculation of pigment, polymer particles, wax, and optional additives; (iii) homogenizing the resulting flocculent mixture with a high shearing device, such as a Brinkmann Polytron or IKA homogenizer, and further stirring with a mechanical stirrer at a temperature of about 3° C. to about 25° C. below the Tg of the latex polymer, for example in the range of from between about 25° C. and about 60° C., to form statically bound aggregates of from about 1 micron to about 14 microns in volume average diameter with a particle size distribution of from about 1.15 to about 1.30 as measured by the Coulter Counter; (iv) adding an encapsulated wax emulsion latex containing a polymer encapsulated wax to the aforementioned aggregates, and wherein the wax encapsulated latex is present in an amount, for example, of from about 10 to about 50 weight percent of the total latexes, and wherein the polymer encapsulating the wax is comprised of polymer particles of, for example, poly (styrene-butyl acrylate-acrylic acid), poly(styrene-butadiene-acrylic acid), and the like, and wherein the wax content is about 5 to about 35 weight percent, preferably about 10 to about 30 weight percent, and there is enabled a thin polymer shell, for example from about 0.01 to about 0.2, and preferably about to 0.03 about 0.15 micron; causing a flocculation of polymer particles, wax, the aforementioned aggregates in (iii), and optional additives; (v) further stirring with a mechanical stirrer at a temperature of about 1° C. to about 25° C. below the Tg of the latex polymer to form statically bound toner sized aggregates of from about 2 microns to about 20 microns in volume average diameter with a particle size distribution of from about 1.15 to about 1.35 as measured by the Coulter Counter; (vi) heating the mixture in the presence of additional anionic surfactant or nonionic surfactant in a quantity of from between 0.1 and 3.0 percent by weight of the total suspension at a temperature of 120° C. or below, for example in the range of from between about 75° C. and about 105° C., for a duration of, for example, from about 1 to about 5 hours to form 2 to about 12 micron toner preferably with a particle size distribution of from about 1.15 to about 1.35 as measured by the Coulter Counter; and (vii) isolating the toner particles by filtration, washing, and drying. The wax is present in the final toner composition in an amount of from about 1 percent by weight to about 15 percent by weight, and preferably in an amount of from about 2 percent by weight to about 10 percent by weight.

The heating of the resulting flocculent mixture is at, for example, below about the resin glass transition temperature, and more specifically, from about 35° C. to about 60° C. (Centigrade) to form toner sized aggregates of from about 2 microns to about 20 microns in volume average diameter, and which toner is comprised of polymer, colorant, encapsulated wax, and optionally additive particles, and this is followed by heating the aggregates formed in suspension above about the resin, or polymer glass transition temperature, and more specifically at, for example, from about 70° C. to about 100° C. to effect coalescence or fusion of the components of the aggregates and to form mechanically stable integral toner particles.

Examples of waxes are known, and include, for example, alkylenes, such as polypropylene, polyethylene, reference U.S. Pat. Nos. 5,023,158; 5,004,666; 4,997,739; 4,988,598; 4,921,771; and 4,917,982; and U.K. Patent 1,442,835, the disclosures of which are totally incorporated herein by reference, and the like. Many of the waxes selected are hydrophobic and essentially water insoluble. Specific examples of waxes are:

(1) natural waxes such as those preferably extracted from vegetables (Carnauba wax, Japan wax, Bayberry wax) or animals (Beeswax, Shellac wax, Spermaceti wax);

(2) mineral waxes, such as those preferably extracted, for example, from bituminous lignite or share (Montan wax, Ozokerite wax, Ceresin wax);

(3) petroleum waxes, complex mixtures of paraffinic hydrocarbons obtained from the distillation of crude petroleum (Paraffin wax), or by dewaxing heavy lubricating oils and petrolatum residues (microcrystalline wax); and (4) synthetic waxes generated, for example, by chemical processes including petroleum, Fischer-Tropsch (by coal gasification), polyethylene, polypropylene, acrylate, fatty acid amides, silicone and polytetrafluoroethylene waxes.

Of these, the petroleum, polyethylene, polypropylene and silicone waxes are preferred for incorporation into the polymer shell latex.

Examples of specific waxes include those as illustrated herein and are available from Allied Chemical and Petrolite Corporation, and examples of wax emulsions include those as illustrated herein which are available from Michaelman Inc, Petrolite Company, the Daniels Products Company, and the Genesee Polymers Corporation, wherein the wax emulsions are prepared dispersions of a wax in water, which dispersion is comprised of a wax, and a dispersant such as a nonionic, ionic or a mixture of surfactants. The paraffin waxes selected preferably possesses a molecular weight $M_w$ of from about 400 to about 1,000, and more preferably from about 500 to about 800, an $M_n$ of from 300 to about 800, and preferably from about 400 to about 600, and melting temperature Tm of from about 50° C. to about 100C, and preferably from about 60° C. to about 80° C. The polyethylene waxes selected preferably possess a molecular weight $M_w$ of from about 1,000 to about 2,000, and more preferably from about 1,000 to about 1,500, an $M_n$ of from about 500 to about 1,500, and yet more preferably from about 700 to about 1,200, and a melting temperature Tm of from about 70° C. to about 130° C., and preferably from about 80° C. to about 100° C. The polyethylene waxes selected possess a molecular weight $M_w$ of from about 1,000 to about 10,000, and preferably from about 4,000 to about 7,000, an $M_n$ of from about 500 to about 8,000, and preferably from about 2,000 to about 6,000, and a melting temperature Tm of from about 120° C. to about 180° C., and preferably from about 140° C. to about 160° C. The silicone waxes selected preferably possess a molecular weight $M_w$ of from about 5,000 to about 20,000, and preferably from about 10,000 to about 15,000, an $M_n$ of from about 2,000 to about 15,000, and preferably from about 3,000 to about 10,000, and a melting temperature Tm of from about 30° C. to about 90° C., and preferably from about 40° C. to about 70° C.

The waxes are present in the final toner composition of the present invention in various amounts, however, generally the waxes are present in the toner composition in an amount of from about 1 percent by weight to about 20 percent by weight, and preferably in an amount of from about 2 percent by weight to about 15 percent by weight.

An emulsifier or surfactant selected for the processes of the present invention, especially for the latex, includes, for example, those of the formula, or encompassed by the formula

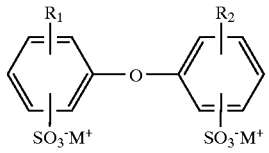

wherein $R_1$ or $R_2$ is hydrogen, or alkyl with, for example, from about 1 to about 25 carbons and preferably from about 6 to about 16 carbon atoms, and M is hydrogen, an alkali metal, such as sodium, or potassium, or ammonium ($NH_4$) with the preferred emulsifier being sodium tetrapropyl diphenyloxide disulfonate. For sodium n-decyl diphenyloxide disulfonate, $R_1$ is hydrogen, $R_2$ is a n-decyl group, and M is sodium. Examples of specific emulsifiers include sodium hexyl diphenyloxide disulfonate, sodium n-decyl diphenyloxide disulfonate, sodium n-dodecyl diphenyloxide disulfonate, sodium n-hexadecyl diphenyloxide disulfonate, sodium palmityl diphenyloxide disulfonate, n-decyl diphenyloxide disulfonic acid, n-dodecyl diphenyloxide disulfonic acid, and tetrapropyl diphenyloxide disulfonic acid.

The emulsifiers or surfactants include diphenyloxide disulfonates, such as DOWFAX 2A1™, DOWFAX 3A2™, DOWFAX 8390™ available Dow Chemical, RHODACAL DSB™ available from Rhone-Poulenc, POLY-TERGENT 2A1™, POLY-TERGENT 2EP™ available from Olin, AEROSOL DPOS-45™ available from Cytec, CALFAX DBA-40™, CALFAX 16L-35™ available from Pilot Chemicals, and the like. Diphenyloxide disulfonates can be prepared by a Friedl-Kraft alkylation reaction of diphenyloxide using defined alkane fractions, followed by sulfonation. Diphenyloxide disulfonate emulsifiers represents a class of highly anionic surface active agents comprised of disulfonated alkyl diphenyl oxide molecules in which the charge arises from two sulfonate groups rather than one as in the majority of surfactants (such as dodecylbenzene sulfonate), provides excellent emulsion stability. The Dow Chemical available components, reference, for example, Dow bulletins entitled "DOWFAX Anionic Surfactants For High Performance Products", should have a high electrolyte tolerance, high mechanical stability, and excellent stability in concentrated acids and alkalis. Diphenyloxide disulfonates also possess high oxidation resistance and high temperature stability up to, for example, 95° C. rendering them suitable for use in emulsion polymerization wherein sediment free latexes are generated.

Optional cosurfactants that may be selected for the processes of the present invention are selected from the group consisting of alkanes, and hydrocarbyl alcohols, ethers, amines, halides and esters, which are substantially inert, substantially nonvolatile, substantially water-insoluble liquid at a temperature of about 40° C. to about 90° C., and contain a terminal aliphatic hydrocarbyl group, and mixtures thereof. The terminal aliphatic hydrocarbyl group of at least about 10, and from about 10 to about 20 carbon atoms contained therein may be unsaturated but is preferably saturated, and branched and is preferably straight chain. These cosurfactants should be relatively highly water insoluble, to the extent of less than about $10^{-3}$ grams, and preferably less than about $10^{-4}$ grams, per liter of water in the aqueous phase, and they should not have too high a molecular weight, for example not more than about 5,000, preferably not more than about 2,000, and still more preferably from about 100 to about 500. Examples of specific cosurfactants include alkanes, such as n-decane, n-tetradecane, n-hexadecane, n-octadecane, eicosane, tetracosane, 1-decene, 1-dodecene, 2-hexadecyne, 2-tetradecyne, 3-octyne, 4-octyne, and 1-tetradecene; alicyclic hydrocarbons, such as dodecyl cyclohexane; aromatic hydrocarbons such as hexadecyl benzene; alcohols such as decanol, lauryl alcohol, tetradecanol, cetyl alcohol, octadecanol, eicosanol, 1-heptadecanol and cetyl alcohol; hydrocarbyl alcohol esters of lower molecular weight carboxylic acids, such as cetyl acetate; ethers, such as octyl ether and cetyl ether; amines, such as tetradecyl amine, hexadecyl amine, and octadecyl amine; halides, such as hexadecyl chloride and other chlorinated paraffins; hydrocarbyl carboxylic acid esters of lower molecular weight alcohols, such as methyl, ethyl and isoamyl octanoate, methyl and octyl caprate, ethyl stearate, isopropyl myristate, methyl, isoamyl and butyl oleate, glyceryl tristearate, soybean oil, coconut oil, tallow, laurin, myristin, olein and the like. With the processes of the present invention, cosurfactants as illustrated herein are selected and preferably cosurfactants of dodecane, hexadecane, lauryl alcohol, or cetyl alcohol, and which cosurfactants can be selected in various suitable amounts, such as from about 0.005 to about 5, and preferably from about 0.5 to about 3 weight percent, or parts based on the monomer, or monomers used to prepare the polymer resin. These cosurfactants can increase the stability of the fine size particle emulsions by inhibiting sedimentation or degradation caused by the tendency of the small particles or droplets to coalescence or diffuse molecularly. The cosurfactants should preferably be inert, and resistant to diffusion into an aqueous medium.

Illustrative examples of specific latex resin, polymer or polymers selected for the process of the present invention include polymers such as poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-butylacrylate), poly(styrene-butadiene), poly(styrene-isoprene), poly(styrene-butyl methacrylate), poly(styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), and the like. The latex polymer is generally present in the toner compositions in various effective amounts, such as from about 75 weight percent to about 98 weight percent of the toner, and the latex resin size suitable for the processes of the present invention can be, for example, from about 0.05 micron to about 1 micron in volume average diameter as measured by the Brookhaven nanosize particle analyzer. Other sizes and effective amounts of latex polymer may be selected in embodiments.

The polymer selected for the process of the present invention is preferably prepared by emulsion polymerization methods, and the monomers utilized in such processes include styrene, acrylates, methacrylates, butadiene, isoprene, acrylic acid, methacrylic acid, acrylonitrile, and the like. Known chain transfer agents, for example dodecanethiol, about 0.1 to about 10 percent, or carbon tetrabromide in effective amounts, such as from about 0.1 to about 10 percent, can also be utilized to control the molecular weight properties of the polymer when emulsion polymerization is selected. Other processes of obtaining polymer particles of from, for example, about 0.01 micron to about 2 microns can be selected from polymer microsuspension process, such as disclosed in U.S. Pat. No. 3,674,736, the disclosure of which is totally incorporated herein by reference, polymer solution microsuspension process, such as disclosed in copending application U.S. Pat. No. 5,290,654, the disclosure of which is totally incorporated herein by reference, mechanical grinding processes, or other known processes.

Various known colorants, such as pigments dyes, mixtures thereof, and the like, present in the toner in an effective amount of, for example, from about 1 to about 15 percent by weight of toner, and preferably in an amount of from about 3 to about 10 percent by weight, that can be selected include carbon black like REGAL 330®; magnetites, such as Mobay magnetites MO8029™, MO8060™; Columbian magnetites; MAPICO BLACKS™ and surface treated magnetites; Pfizer magnetites CB47991™, CB5300™, CB5600™, MCX6369™; Bayer magnetites, BAYFERROX 8600™; 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments and dyes that can be selected are cyan, magenta, or yellow pigments, and mixtures thereof. Examples of magentas include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyans include copper tetra(octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellows that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention.

Colorants include pigments, dyes, mixtures of pigments and dyes, mixtures of pigments, mixtures of dyes, and the like.

The toner may also include known charge additives in effective suitable amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like.

Surfactants in effective amounts of, for example, 0.01 to about 15 weight percent of the reaction mixture in embodiments include, for example, nonionic surfactants, such as dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™; in effective amounts of, for example, from about 0.1 to about 10 percent by weight of the reaction mixture; anionic surfactants, such as for example sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, BIOSOFT D-40™ obtained from Stepan, and the like, in effective amounts of, for example, from about 0.01 to about 10 percent by weight; cationic surfactants, such as for example dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, in effective amounts of, for example, from about 0.01 percent to about 10 percent by weight. Preferably, the molar ratio of the cationic surfactant used for flocculation to the anionic surfactant used in the latex preparation is in the range of from about 0.5 to 4.

Examples of the surfactant, which can be added to the aggregates before coalescence is initiated, can be various suitable surfactants such as anionic surfactants, such as sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, BIOSOFT D-40™ obtained from Stepan, and the like. They can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520™; IGEPAL CA-720™, IGEPAL CO-890™, IGEPAL CO-720™, IGEPAL CO-290™, IGEPAL CA-210™, ANTAROX 890™ and ANTAROX 897™. An effective amount of the anionic, or similar suitable or nonionic surfactant utilized in the coalescence to primarily stabilize the aggregate size against further growth with temperature is, for example, from about 0.01 to about 10 percent by weight, and preferably from about 0.5 to about 5 percent by weight of the reaction.

Surface additives that can be added to the toner compositions after washing or drying include, for example, metal salts, metal salts of fatty acids, colloidal silicas, metal oxides like titanium oxides, mixtures thereof and the like, which additives are each usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate AEROSIL R972® available from Degussa, coated silicas, such as those of copending applications U.S. Ser. No. 09/132,185, U.S. Ser. No. 09/132,188, U.S. Ser. No. 09/132,623, the disclosures of which are totally incorporated herein by reference, each in amounts of from about 0.1 to about 2 percent which can be added during the process or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. Nos. 4,265,990; 4,585,884 and 4,563,408, the disclosures of which are totally incorporated herein by reference.

The following Examples are being submitted to further illustrate various pieces of the present invention. These Examples are intended to be illustrative only and are not intended to limit the scope of the present invention.

EXAMPLE I

A wax encapsulated latex comprised of a wax core and a polymer shell of styrene/butyl acrylate/acrylic acid of 78/22/3 parts (by weight throughout unless otherwise indicated) in composition was prepared by a semicontinuous emulsion polymerization, as follows. A 2 liter jacketed glass flask with a stirrer set at 200 rpm, and containing 108 grams of Petrolite 01™ wax emulsion (paraffin wax, 50 percent active, available from Petrolite), 3.0 grams of DOWFAX 2A1™ (sodium tetrapropyl diphenyloxide disulfonate, 47 percent active, available from Dow Chemical), 1.0 gram of polyoxyethylene nonyl phenyl ether nonionic surfactant, ANTAROX CA 897™ (70 percent active), and 509 grams of deionized water was purged with nitrogen for 60 minutes while the temperature was from about 25° C. to 80° C. A monomer emulsion was prepared by homogenizing a monomer mixture (379 grams of styrene, 107 grams of n-butyl acrylate, 14.6 grams of acrylic acid, and 6.3 grams of 1-dodecanethiol) with an aqueous solution (1.5 grams of DOWFAX 2A1™, 0.5 grams of ANTAROX CA-897™, 7.3 grams of ammonium persulfate, and 253 grams of deionized water) at 10,000 rpm for 5 minutes at room temperature of about 25° C. via VirTishear Cyclone Homogenizer. To the heated wax emulsion, the 770 grams of monomer emulsion were fed continuously into the reactor over 4 hours and 50 minutes at 80° C. The nitrogen purge was reduced to a slow trickle to maintain a small positive pressure. After monomer emulsion addition was completed, the reaction was allowed to post react for 90 minutes at 80° C., then cooled to 25° C. by cold water. The resulting wax polymer encapsulated latex polymer possessed an $M_w$ of 31,000, and an $M_n$ of 5,700, as determined on a Waters GPC, and a mid-point Tg of 49.1° C., as measured on a Seiko DSC. The latex polymer possessed a volume average diameter of 299 nanometers as measured by light scattering technique on a Coulter N4 Plus Particle Sizer. 260.0 Grams of the above prepared wax containing latex emulsion and 220.0 grams of an aqueous cyan dispersion containing 7.6 grams of Cyan Pigment 15:3, and 2.3 grams of alkylbenzyldimethyl ammonium chloride cationic surfactant, SANIZOL B-50™ (60 percent active, available from Kao Chemicals) were simultaneously added to 400 milliliters of water with high shear stirring at 10,000 rpm for 3 minutes by means of a polytron. The resulting mixture was then transferred to a 2 liter reaction vessel and heated at a temperature of 50° C. for 2 hours before 30 milliliters of 20 percent aqueous BIOSOFT D-40™ (sodium dodecyl benzene sulfonate, available from Stepan) solution were added. Aggregates with a particle size (volume average diameter) of 8.0 microns with a GSD=1.18, as measured on the Coulter Counter, were obtained. Subsequently, the mixture was heated to 93° C. and held there for a period of 3 hours before cooling down to room temperature, about 25° C. throughout, filtered, washed with water, and dried in a freeze dryer. The final toner product evidenced a particle size of 8.7 microns in volume average diameter with a particle size distribution of 1.24 as measured on a Coulter Counter.

The resulting toner, that is the above final toner product, was comprised of about 84 percent of polymer, poly (styrene-butyl acrylate-acrylic acid), about 9 percent of wax, and Cyan Pigment 15:3, about 7 percent by weight of toner, with an volume average diameter of 8.7 microns and a GSD of 1.24.

Solid area patches of this toner with a TMA (toner mass per unit area) of 0.55 milligrams/cm$^2$ on a paper substrate were fused using a laboratory fusing fixture employing a Xerox Corporation 5765 fuser roll subassembly modified to allow for controlled and adjustable temperature fuser conditions. The hot offset temperature (HOT) is determined by the first signs of toner being transferred from the paper to the fuser roll. This toner with wax encapsulated polymer was found to have a HOT of 200° C.

Comparative Example A

A latex was prepared by the semicontinuous emulsion polymerization of styrene/butyl acrylate/acrylic acid, 75/25/3 parts (by weight), as follows. A 2 liter jacketed glass flask with a stirrer set at 200 rpm, and containing 8.8 grams of DOWFAX 2A1™ (47 percent active), 6.0 grams of ANTAROX CA 897™ (70 percent active), and 519 grams of deionized water was purged with nitrogen for 30 minutes while the temperature was from about 25° C. to 80° C. A monomer emulsion was prepared by homogenizing a monomer mixture (405 grams of styrene, 135 grams of n-butyl acrylate, 16.2 grams of acrylic acid, and 8.1 grams of 1-dodecanethiol) with an aqueous solution (4.4 grams of DOWFAX 2A1™, 3.0 grams of ANTAROX CA-897™, and 251 grams of deionized water) at 10,000 rpm for 5 minutes at room temperature of about 25° C. via VirTishear Cyclone Homogenizer. Forty one (41) grams of seed were removed from the monomer emulsion and added into the flask, and the flask contents were stirred for 5 minutes at 80° C. An initiator solution prepared from 8.1 grams of ammonium persulfate in 40 grams of deionized water was added to the flask mixture over 20 minutes. Stirring continued for an additional 20 minutes to allow a seed particle formation. The remaining 782 grams of monomer emulsion were fed continuously into the reactor over 4 hours and 40 minutes. The nitrogen purge was reduced to a slow trickle to maintain a small positive pressure. After the above monomer emulsion addition was completed, the reaction was allowed to post react for 120 minutes at 80° C. No strong exotherm was observed throughout the reaction when the above in situ seeded, monomer emulsion fed process was implemented. Only a very mild exotherm of about 0.3° C. was observed during the initial seed formation stage. The resulting latex polymer possessed an $M_w$ of 28,000, an $M_n$ of 9,100, as determined on a Waters GPC, and a mid-point Tg of 53.5° C., as measured on a Seiko DSC. The latex resin possessed a volume average diameter of 175 nanometers as measured by light scattering technique on a Coulter N4 Plus Particle Sizer.

260.0 Grams of the above prepared latex emulsion and 220.0 grams of an aqueous cyan pigment dispersion containing 7.6 grams of Cyan Pigment 15:3, and 2.3 grams of cationic surfactant SANIZOL B-50™ (60 percent active) were simultaneously added to 400 milliliters of water with high shear stirring at 7,000 rpm for 3 minutes by means of a polytron. The resulting mixture was then transferred to a 2 liter reaction vessel and heated at a temperature of 48° C. for 1.5 hours before 30 milliliters of 20 percent aqueous BIOSOFT D-40™ solution were added. Aggregates with a particle size (volume average diameter) of 6.8 microns with a GSD=1.17, as measured on the Coulter Counter, were obtained. Subsequently, the mixture was heated to 93° C. and held there for a period of 2.5 hours before cooling down to room temperature, about 25° C. throughout, filtered, washed with water, and dried in a freeze dryer. The final toner product evidenced a particle size of 7.4 microns in volume average diameter with a particle size distribution of 1.19 as measured on a Coulter Counter.

The resulting toner, that is the above final toner product, was comprised of about 93 percent of polymer, poly (styrene-butyl acrylate-acrylic acid), and Cyan Pigment 15:3, about 7 percent by weight of toner, with an volume average diameter of 7.4 microns and a GSD of 1.19.

The fusing behavior of this toner was determined using the same experimental conditions as reported for the Example I toner above, and the hot offset temperature (HOT) was determined to be 180° C., some 20° C. lower than the HOT of the Example I toner which contained wax.

EXAMPLE II

A wax encapsulated polymer comprised of a wax core and a polymer shell of styrene/butyl acrylate/acrylic acid of 80/20/3 parts (by weight throughout unless otherwise indicated) in composition was prepared by a semicontinuous emulsion polymerization, as follows. A 2 liter jacketed glass flask with a stirrer set at 200 rpm, and containing 210 grams of Petrolite LX-1 164™ wax emulsion (polyethylene wax, 40 percent active), 3.0 grams of DOWFAX 2A1™ (47 percent active), 1.0 gram of ANTAROX CA 897™ (70 percent active), and 679 grams of deionized water was purged with nitrogen for 60 minutes while the temperature was from about 25° C. to 80° C. A monomer emulsion was prepared by homogenizing a monomer mixture (269 grams of styrene, 67 grams of n-butyl acrylate, 10.1 grams of acrylic acid, and 4.4 grams of 1-dodecanethiol) with an aqueous solution (1.5 grams of DOWFAX 2A1™, 0.5 gram of ANTAROX CA-897™, 5.0 grams of ammonium persulfate, and 175 grams of deionized water) at 10,000 rpm for 5 minutes at room temperature of about 25° C. via VirTishear Cyclone Homogenizer. To the heated wax emulsion, the 532 grams of monomer emulsion were fed continuously into the reactor over 3 hours and 53 minutes at 80° C. The nitrogen purge was reduced to a slow trickle to maintain a small positive pressure. After monomer emulsion addition was completed, the reaction was allowed to post react for 90 minutes at 80° C., then cooled to 25° C. by cold water. The resulting wax encapsulated polymer possessed an $M_w$ of 27,000, and an $M_n$ of 5,500, as determined on a Waters GPC, and a mid-point Tg of 52.5° C., as measured on a Seiko DSC. The polymer possessed a volume average diameter of 421 nanometers as measured by light scattering technique on a Coulter N4 Plus Particle Sizer.

173.0 Grams of the above prepared wax containing latex emulsion, 130.0 grams of the latex emulsion of Comparative Example A, and 220.0 grams of an aqueous cyan dispersion containing 7.6 grams of Cyan Pigment 15:3, and 2.3 grams of cationic surfactant SANIZOL B-50™ (60 percent active) were simultaneously added to 357 milliliters of water with high shear stirring at 10,000 rpm for 3 minutes by means of a polytron. The resulting mixture was then transferred to a 2 liter reaction vessel and heated at a temperature of 49° C. for 2 hours before 30 milliliters of 20 percent aqueous BIOSOFT D-40™ solution were added. Aggregates with a particle size (volume average diameter) of 7.0 microns with a GSD=1.19, as measured on the Coulter Counter, were obtained. Subsequently, the mixture was heated to 93° C. and held there for a period of 3 hours before cooling down to room temperature, about 25° C. throughout, filtered, washed with water, and dried in a freeze dryer. The final toner product evidenced a particle size of 7.3 microns in volume average diameter with a particle size distribution of 1.22 as measured on a Coulter Counter.

The resulting toner, that is the above final toner product, was comprised of about 84 percent of polymer, poly (styrene-butyl acrylate-acrylic acid), about 9 percent of polyethylene wax, and Cyan Pigment 15:3, about 7 percent by weight of toner, with a volume average diameter of 7.3 microns and a GSD of 1.22.

The fusing behavior of this toner was determined using the same experimental conditions as reported in Example I, and the hot offset temperature (HOT) was determined to be 205° C., some 25° C. higher than the HOT of the Comparative Example A toner, which contained no wax.

EXAMPLE III

A wax comprised a wax core and a polymer shell of styrene/butyl acrylate/acrylic acid of 83/17/3 parts (by weight throughout unless otherwise indicated) in composition was prepared by a semicontinuous emulsion polymerization, as follows. A 2 liter jacketed glass flask with a stirrer set at 200 rpm, and containing 144 grams of Polywax 725™ wax emulsion (polyethylene wax, 30 percent active), 4.4 grams of DOWFAX 2A1™ (47 percent active), 1.6 grams of ANTAROX CA 897™ (70 percent active), and 681 grams of deionized water was purged with nitrogen for 60 minutes while the temperature was from about 25° C. to about 80° C. A monomer emulsion was prepared by homogenizing a monomer mixture (314 grams of styrene, 64 grams of n-butyl acrylate, 11.3 grams of acrylic acid, and 7.5 grams of 1-dodecanethiol) with an aqueous solution (2.2 grams of DOWFAX 2A1™, 0.8 gram of ANTAROX CA-897™, 5.7 grams of ammonium persulfate, and 197 grams of deionized water) at 10,000 rpm for 10 minutes at room temperature of about 25° C. via VirTishear Cyclone Homogenizer. To the resulting heated wax emulsion, the 603 grams of the above monomer emulsion were fed continuously into the reactor over 3 hours and 48 minutes at 80° C. The nitrogen purge was reduced to a slow trickle to maintain a small positive pressure. After monomer emulsion addition was completed, the reaction was allowed to post react for 90 minutes at 80° C., then cooled to 25° C. by cold water. The resulting wax encapsulated latex polymer possessed an $M_w$ of 32,000, and an $M_n$ of 9,900, as determined on a Waters GPC, and a mid-point Tg of 54.3° C., as measured on a Seiko DSC. The latex resin possessed an volume average diameter of 294 nanometers as measured by light scattering technique on a Coulter N4 Plus Particle Sizer.

176.0 Grams of the latex emulsion of Comparative Example A, and 220.0 grams of an aqueous cyan dispersion containing 7.6 grams of Cyan Pigment 15:3, and 2.3 grams of cationic surfactant SANIZOL B-50™ (60 percent active) were simultaneously added to 372 milliliters of water with high shear stirring at 10,000 rpm for 3 minutes by means of a polytron. The resulting mixture was then transferred to a 2 liter reaction vessel and heated at a temperature of 48° C. for 2 hours before 112.0 grams of the above prepared wax containing latex emulsion was added. Subsequently, the mixture was heated to 50° C. and held there for a period of 1 hour before 30 milliliters of 20 percent aqueous BIOSOFT D-40™ solution were added. Aggregates with a particle size (volume average diameter) of 6.8 microns with a GSD=1.19, as measured on the Coulter Counter, were obtained. The mixture was then heated to 93° C. and held there for a period of 3 hours before cooling down to room temperature, about 25° C. throughout, filtered, washed with water, and dried in a freeze dryer. The final toner product evidenced a particle size of 7.6 microns in volume average diameter with a particle size distribution of 1.24 as measured on a Coulter Counter.

The resulting toner, that is the above final toner product, was comprised of about 90 percent of polymer, poly (styrene-butyl acrylate-acrylic acid), about 3 percent of the above wax, and Cyan Pigment 15:3, about 7 percent by weight of toner, with an volume average diameter of 7.6 microns and a GSD of 1.24.

The fusing behavior of this toner was determined using the same experimental conditions as reported for the Example I toner above, and the hot offset temperature (HOT) was determined to be 210° C., some 30° C. higher than the HOT of the Comparative Example A toner which contained no wax.

EXAMPLE IV

A wax encapsulated latex comprised of a wax core and a polymer shell of styrene/butyl acrylate/acrylic acid of 75/25/3 parts (by weight throughout unless otherwise indicated) in composition was prepared by a semicontinuous emulsion polymerization, as follows. A 2 liter jacketed glass flask with a stirrer set at 200 rpm, and containing 140 grams of EXP-24-LS™ wax emulsion (silicone wax, 15 percent active, available from Genesee Polymers), 4.4 grams of DOWFAX 2A1™ (47 percent active), 1.6 grams of ANTAROX CA 897™ (70 percent active), and 660 grams of deionized water was purged with nitrogen for 60 minutes while the temperature was from about 25° C. to 80° C. A monomer emulsion was prepared by homogenizing a monomer mixture (299 grams of styrene, 100 grams of n-butyl acrylate, 12.0 grams of acrylic acid, and 6.0 grams of 1-dodecanethiol) with an aqueous solution (2.2 grams of DOWFAX 2A1™, 0.8 gram of ANTAROX CA-897™, 6.0 grams of ammonium persulfate, and 210 grams of deionized water) at 10,000 rpm for 5 minutes at room temperature of about 25° C. via VirTishear Cyclone Homogenizer. To the heated wax emulsion, 636 grams of the above monomer emulsion were fed continuously into the reactor over 3 hours and 30 minutes at 80° C. The nitrogen purge was reduced to a slow trickle to maintain a small positive pressure. After monomer emulsion addition was completed, the reaction was allowed to post react for 90 minutes at 80° C., then cooled to 25° C. by cold water. The resulting wax encapsulated latex polymer possessed an $M_w$ of 33,000, and an $M_n$ of 7,200, as determined on a Waters GPC, and a mid-point Tg of 52.1° C., as measured on a Seiko DSC. The latex polymer possessed an volume average diameter of 266 nanometers as measured by light scattering technique on a Coulter N4 Plus Particle Sizer.

347.0 Grams of the above prepared wax containing latex emulsion and 220.0 grams of an aqueous cyan pigment dispersion containing 7.6 grams of Cyan 15:3, and 2.3 grams of cationic surfactant SANIZOL B-50™ (60 percent active) were simultaneously added to 87 milliliters of water with high shear stirring at 10,000 rpm for 3 minutes by means of a polytron. The resulting mixture was then transferred to a 2 liter reaction vessel and heated at a temperature of 48° C. for 2.5 hours before 30 milliliters of 20 percent aqueous BIOSOFT D-40™ solution were added. Aggregates with a particle size (volume average diameter) of 6.7 microns with a GSD=1.19, as measured on the Coulter Counter, were obtained. Subsequently, the mixture was heated to 93° C. and held there for a period of 3 hours before cooling down to room temperature, about 25° C. throughout, filtered, washed with water, and dried in a freeze dryer. The final toner product evidenced a particle size of 7.7 microns in volume average diameter with a particle size distribution of 1.23 as measured on a Coulter Counter.

The resulting toner, that is the above final toner product, was comprised of about 88.4 percent of polymer, poly (styrene-butyl acrylate-acrylic acid), about 4.6 percent of wax, and Cyan Pigment 15:3, about 7 percent by weight of toner, with a toner volume average diameter of 7.7 microns and a GSD of 1.23.

The fusing behavior of this toner was determined using the same experimental conditions as reported for the Example I toner above, and the hot offset temperature (HOT) was determined to be 205° C., some 25° C. higher than the HOT of the Comparative Example A toner which contained no wax.

Other modifications of the present invention will occur to those of ordinary skill in the art subsequent to a review of the present application. These modifications and equivalents, or substantial equivalents thereof are intended to be included within the scope of the present invention.

What is claimed is:

1. A process for the preparation of toner comprising (i) aggregating a colorant dispersion with an encapsulated wax;

(ii) coalescing or fusing the aggregates generated; and optionally (iii) isolating, washing, and drying the toner.

2. A process in accordance with claim 1 wherein the encapsulated wax is generated by the free radical polymerization of a wax dispersion, monomer, and initiator, and wherein the free radical polymerization is accomplished by heating at a temperature of from about 25° C. to about 125° C. and there results said wax incorporated in a shell polymer, and wherein the thickness of the shell is from about 0.01 to about 0.3 micron.

3. A process in accordance with claim 1 wherein the wax is present as a dispersion in water, and wherein said wax is present in an amount of about 1 to about 35 percent by weight.

4. A process in accordance with claim 1 wherein said wax is encapsulated within a polymer and said aggregating is below about the polymer glass transition temperature present as a latex emulsion, the coalescing or fusing of said aggregates is above about the polymer glass transition temperature, and there results toner with a size of from about 2 to about 20 microns in volume average diameter.

5. A process in accordance with claim 4 wherein said temperature below the glass transition temperature is from about 25° C. to about 60° C., and said heating above the glass transition temperature is from about 60° C. to about 100° C.

6. A process in accordance with claim 4 wherein said temperature below the glass transition temperature is from about 35° C. to about 55° C., and said heating above the glass transition temperature is from about 70° C. to about 95° C.

7. A process in accordance with claim 4 wherein the temperature at which said aggregation is accomplished controls the size of the aggregates, and wherein the final toner size is from about 2 to about 10 microns in volume average diameter, and wherein the temperature and time of said coalescence or fusing of the components of aggregates control the shape of the resultant toner.

8. A process in accordance with claim 4 wherein the aggregation temperature is from about 45° C. to about 55° C., and wherein the coalescence or fusing temperature is from about 80° C. to about 95° C.

9. A process in accordance with claim 1 wherein there is further selected a cosurfactant selected from the group consisting of alkanes, hydrocarbyl alcohols, ethers, amines, halides, and esters.

10. A process in accordance with claim 1 wherein the colorant is a pigment, and wherein said pigment dispersion contains an ionic surfactant.

11. A process in accordance with claim 1 wherein there is further included a surfactant in the colorant dispersion, and which surfactant is a cationic surfactant.

12. A process in accordance with claim 1 wherein the aggregating is conducted at a temperature of about 15° C. to about 1° C. below the Tg of the latex polymer, or latex resin for a duration of from about 0.5 hour to about 3 hours; and wherein the coalescence or fusing of the components of aggregates for the formation of integral toner particles comprised of colorant, resin, encapsulated wax, and additives is accomplished at a temperature of about 85° C. to about 105° C. for a duration of from about 1 hour to about 5 hours, and wherein the wax is substantially totally incorporated in the toner.

13. A process in accordance with claim 1 wherein the wax is encapsulated within a polymer selected from the group consisting of poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid.

14. A process in accordance with claim 1 wherein the colorant is aggregated with an encapsulated wax latex containing a polymer selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), and poly(butyl acrylate-isoprene); poly(styrene-propyl acrylate), poly(styrene-butyl acrylate), poly(styrene-butadiene-acrylic acid), poly (styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), and poly(styrene-butyl acrylate-acrylonitrile-acrylic acid.

15. A process in accordance with claim 1 wherein the colorant is carbon black, cyan, yellow, magenta, and mixtures thereof.

16. A process in accordance with claim 1 wherein the toner particles isolated are from about 2 to about 10 microns in volume average diameter, and the particle size distribution thereof is from about 1.15 to about 1.30, and wherein there is added to the surface of the formed toner metal salts, metal salts of fatty acids, silicas, metal oxides, or mixtures thereof, each in an amount of from about 0.1 to about 10 weight percent of the obtained toner particles.

17. A process in accordance with claim 1 wherein the wax is an alkylene.

18. A process in accordance with claim 1 wherein the wax is paraffin, polyethylene, polypropylene, or silicone waxes; the paraffin waxes have a molecular weight $M_w$ of from 400 to about 1,000, an $M_n$ of from 300 to about 800, and a melting temperature Tm of from 50° C. to about 100° C.; the polyethylene waxes have an $M_w$ of from 1,000 to about 2,000, an $M_n$ of from 500 to about 1,500, and a Tm of from 70° C. to about 130° C.; the polyethylene waxes have an $M_w$ of from 1,000 to about 10,000, an $M_n$ of from 500 to about 8,000, and a Tm of from 120° C. to about 180° C.; and the silicone waxes have an $M_w$ of from 5,000 to about 20,000, an $M_n$ of from 2,000 to about 15,000, and a Tm of from 30° C. to about 90° C.

19. A process in accordance with claim 1 wherein said encapsulated wax is present in the toner product in an amount of about 1 to about 10 weight percent.

20. A process for minimizing the amount of wax that escapes from a toner, which process comprises the mixing of a latex, an encapsulated wax, and a colorant dispersion; heating below about, or equal to about the resin Tg, and heating above about, or equal to about the resin Tg.

21. A process for the preparation of toner comprising (i) aggregating a colorant with a polymer encapsulated wax;

(ii) coalescing, and optionally (iii) isolating, washing, and drying the toner.

22. A process in accordance with claim 21 wherein the encapsulated wax is generated by the free radical polymerization of a wax dispersion, monomer, and initiator, and isolating, washing, and drying is accomplished.

23. A process in accordance with claim 1 wherein isolating, washing, and drying are accomplished, and wherein prior to said isolating cooling is accomplished subsequent to coalescing.

24. A toner obtained by the process of claim 21.

25. A developer comprised of the toner obtained by the process of claim 21 and carrier.

26. A process in accordance with claim 1 wherein the wax is encapsulated within a polymer.

27. A process in accordance with claim 26 wherein the wax is polyethylene, polypropylene, or mixtures thereof.

* * * * *